United States Patent [19]

Kozacka

[11] 4,297,667

[45] Oct. 27, 1981

[54] FUSIBLE ELECTRIC CABLE PROTECTOR

[75] Inventor: Frederick J. Kozacka, South Hampton, N.H.

[73] Assignee: Gould Inc., Rolling Meadows, Ill.

[21] Appl. No.: 136,629

[22] Filed: Apr. 2, 1980

[51] Int. Cl.[3] ..... H01H 85/16

[52] U.S. Cl. ..... 337/251; 337/413

[58] Field of Search ..... 337/26, 248, 251, 252, 337/253, 413

[56] References Cited

U.S. PATENT DOCUMENTS

| | | | |
|---|---|---|---|
| 2,625,626 | 1/1953 | Matthysse | 337/251 X |
| 2,918,551 | 12/1959 | Kozacka | 337/251 X |
| 3,007,019 | 10/1961 | Kozacka | 337/248 X |

*Primary Examiner*—George Harris

*Attorney, Agent, or Firm*—Erwin Salzer

[57] ABSTRACT

A fusible electric cable protector has a casing that defines a first internal space containing the fusible elements and a granular arc-quenching filler. At least one of the pair of terminal elements closing the casing is conductively connected to one connecting element that extends axially outwardly from the aforementioned terminal element and whose purpose is to connect the cable protector into an electric circuit. That connecting element has a cylindrical outer surface and is hollow, thus defining a second internal space filled with a granular arc-quenching filler. The aforementioned first internal space and the aforementioned second internal space are in communication by a passageway in one of the pair of terminal elements. A plug normally closes the open end of the cylindrical connecting element.

3 Claims, 3 Drawing Figures

FUSIBLE ELECTRIC CABLE PROTECTOR

BACKGROUND OF THE INVENTION

This invention relates to a fusible electric cable protector as widely known in the art and widely used. A prior art cable protector is, for instance, disclosed in U.S. Pat. No. 3,132,223 to P. C. Jacobs, Jr.; May 5, 1965 for Fusible Protective Device for Cable Protection.

The connector elements of cable protectors vary depending upon the particular application thereof. If a cable protector is intended to interconnect a bus bar, or the like, and a cable, one connector element will be in the shape of a blade contact, or the like, adapted to be connected, e.g. screwed, against a bus bar while the other connector element will be adapted to be connected to a cable, e.g. may be tubular to receive the end of a cable as shown, for instance, in FIG. 4 of the above referred-to patent.

One connecting element may also be rod-like, in which case the outer surface thereof is engaged by annular contact means adapted to insert it into an electric circuit of a cable. Cable connectors having rod-like connecting elements are relatively heavy and require a relatively large mass of metal for the connecting element, or elements.

The pressure generated in all prior art cable connectors is relatively high, and while high pressure contributes to effective arc-interruption, it also requires great mechanical stability, in particular a great dynamic strength of the casing.

To allow the hot arc products to leak out of the casing is not permissible because this might short-circuit other parts between which a voltage gradient exists.

The present invention provides an improved electric cable protector which is not subject to the aforementioned disadvantages of prior art cable protectors.

SUMMARY OF THE INVENTION

A fusible electric cable protector according to the present invention includes a casing of electric insulating material defining a first internal space, a pair of terminal elements each located on one end of said casing and closing said casing, fusible elements conductively interconnecting said pair of terminal elements, a granular arc-quenching filler inside said first internal space embedding said fusible elements, a pair of connecting elements each conductively connected to one of said pair of terminal elements and extending axially outwardly from said pair of terminal elements for connecting said cable protector into an electric circuit, at least one of said pair of connecting elements having an outer cylindrical surface.

According to this invention a second internal space is defined by said one of said pair of connector elements having an outer cylindrical surface, said second internal space is filled with a granular arc-quenching filler, said second internal space and said first internal space communicate with each other by a passageway extending through one of said pair of terminal elements, and said one of said pair of connector elements having a cylindrical surface being closed at the axially outer end thereof to preclude loss of said granular arc-quenching filler.

DESCRIPTION OF PREFERRED EMBODIMENT

Figure 1:
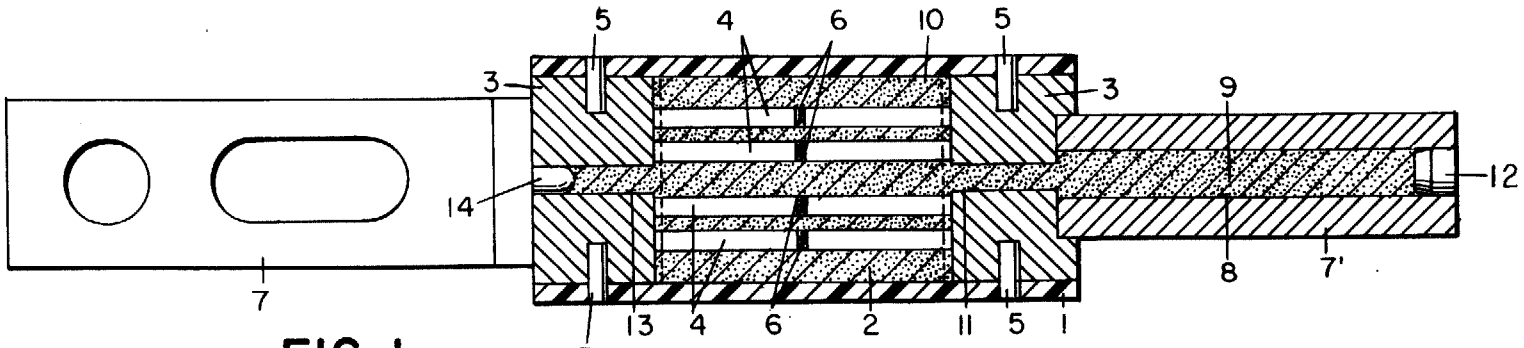
FIG. 1 shows a cable protector according to this invention mainly in longitudinal section.
Figure 3:
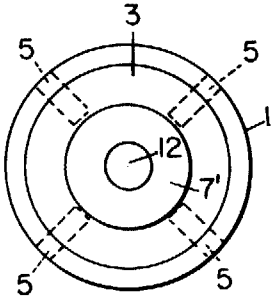
FIG. 3 is an end view of the structure shown in FIG. 1 seen from right to left.
Figure 2:
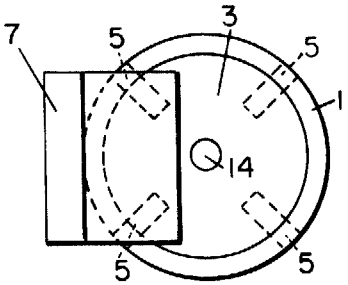
FIG. 2 is an end view of the structure of FIG. 1 seen from left to right.

Referring now to the drawings, numeral 1 has been applied to indicate a casing of electric insulating material defining a first internal space 2. Internal space 2 may be in the shape of a hollow cylinder. A pair of terminal elements 3, e.g. terminal plugs, closes the ends of casing 1. Each terminal element 3 is located on one end of casing 1 and closes that one end. Fusible elements 4 conductively interconnect the pair of terminal elements 3. Fusible elements 4 are in the form of perforated metal ribbons (the perforations of which are not shown) and the ends of which enter grooves in the axially inner end surfaces of terminal elements 3 and are soldered in position therein.

It will be understood that the terminal plugs 3 shown in the drawing may be substituted by other terminal elements and are of an exemplary nature only. Plugs 3 are press-fitted into casing 1 and steel pins 5 project through casing 1 into plugs 3, thus firmly uniting both parts.

Fusible elements 4 may have one or more points of reduced cross-sectional area to define points of arc initiation at high current intensities. (These points of reduced cross-sectional area have not been shown in the drawing.) Each fusible element 4 has further an M-effect causing overlay 6 adjacent the center thereof where arc-initiation occurs at protracted overload currents. A pair of connecting elements 7 and 7' extends axially outwardly from terminal elements or terminal plugs 3. Connecting element 7 is substantially L-shaped and is intended to connect the cable protector to a bus bar or the like. Connecting element 7' is in the shape of a hollow cylinder and defines a second internal space 8 which is filled with a granular arc-quenching filler 9. A passageway 11 or central bore in the right plug 3 connects the first internal space 2 defined by casing 1 and the second internal space 8 defined by connecting element 7'. The first internal space 2 is filled with granular arc-quenching filler 10 in which fusible elements 4 are embedded.

It will be noted that the cross-sectional area of passageway 11 by which spaces 2 and 8 communicate is less than the cross-sectional area of the second internal space 8. The axially outer end of connecting element 7' is normally closed by a plug 12 and is filled with granular arc-quenching filler 9 through an aperture closed after filling by plug 12.

The left terminal element or terminal plug 3 is provided with a passageway 13 for filling the first internal space 2 with a granular arc-quenching filler 10. Thus each of spaces 2 and 8 can be filled separately with granular filler. This is important since space 8 could not effectively be refilled with granular filler through the passageway 13 in the left terminal element or plug 3. Passageway 13 is closed upon filling space 2 by a plug 14. The filling with granular arc-quenching filler of space 8 through space 2 would be particularly difficult since, as stated above, passageway 11 should preferably have a smaller cross-section than the cross-section of second space 8.

Upon fusion of fusible elements 4 arcs in parallel are kindled in space 2 which are effectively quenched by arc-quenching filler 10. The arc discharge which takes place inside of space 2 is a plasma discharge, i.e. it involves thermally ionized metal vapors and free electrons. Space 8 and the granular arc-quenching filler 9 therein provides an aftercooler for hot products of arcing generated inside of space 2. It allows casing 1 to be made of a material which has a relatively small mechanical strength and increases the rate of cooling of the arc products in space 2 of casing 1. The relative narrowness of passageway 11 reduces the time involved in the outflow of arc products generated in chamber 2 into chamber 8 in comparison with any imaginary design lacking a leakage-path of reduced cross-sectional area. The leakage-path or passageway 11 allows initially a relatively high pressure build-up in space 2, which is essential for arc interruption therein. On the other hand, leakage-path 11 allows ultimately a larger expansion of the arc products formed in space 2 in comparison with any prior art design lacking a leakage-path from the arc chamber. The leakage-path 11, in turn, results in a more effective cooling of the arc products when the pressure initially needed for arc-extinction is not needed any longer for that purpose. After arc-extinction the arc energy which had initially been converted into pressure in chamber 2 is converted into kinetic energy, since the cross-section of passageway 11 is much less than that of chamber 2, and is ultimately dissipated in chamber or space 8.

I claim as my invention:

1. A fusible electric cable protector including a casing of electric insulating material defining a first internal space, a pair of terminal elements each located on one end of said casing and closing said casing, fusible elements conductively interconnecting said pair of terminal elements, a granular arc-quenching filler inside said first space, a pair of connector elements each conductively connected to one of said pair of terminal elements and each extending axially outwardly from one of said pair of terminal elements for connecting said cable protector into an electric circuit, at least one of said pair of connector elements having a cylindrical outer surface wherein the improvement comprises a second internal space defined by said one of said pair of connector elements having a cylindrical outer surface, said second internal space being filled with a granular arc-quenching filler, said second internal space and said first internal space communicating with each other by a passageway extending through one of said pair of terminal elements, and said one of said pair of connector elements having a cylindrical surface being closed at the axially outer end thereof to preclude loss of said granular arc-quenching filler.

2. A fusible cable protector as specified in claim 1 wherein (a) said one of said pair of connector elements having a cylindrical outer surface is conductively connected with one end thereof to one of a pair of terminal plugs press-fitted into said casing; and wherein (b) said one of said pair of terminal plugs has a central bore forming a passageway interconnecting said first internal space and said second internal space.

3. A fusible cable protector as specified in claim 1 wherein said passageway has a relatively small diameter, and said second internal space has a relatively larger diameter, and wherein the axially outer end of said one of said pair of connector elements having a cylindrical outer surface is provided with a plug means normally closing said second internal space.

* * * * *